United States Patent [19]

Gifford

[11] Patent Number: 4,775,345

[45] Date of Patent: Oct. 4, 1988

[54] SURF AIR STRAP

[76] Inventor: Christopher E. Gifford, 1009 Maluna St., #A, Honolulu, Hi. 96818

[21] Appl. No.: 37,625

[22] Filed: Apr. 13, 1987

[51] Int. Cl.[4] ..... A63C 15/06

[52] U.S. Cl. ..... 441/75; 36/114; 36/59 R

[58] Field of Search ..... 114/39.2; 441/61, 65, 441/74, 75; 36/102, 114, 7.6, 7.7, 11.5, 25 R, 59 R, 59 A, 59 C

[56] References Cited

U.S. PATENT DOCUMENTS

| | | | |
|---|---|---|---|
| 2,685,141 | 8/1954 | Davenport | 36/59 C |
| 2,740,208 | 4/1956 | Dye | 36/59 R |
| 3,640,006 | 2/1972 | Kendrick | 36/8.1 |
| 3,838,528 | 10/1974 | Johnson | 36/7.7 |
| 4,118,878 | 10/1978 | Semon | 36/8.1 |
| 4,285,082 | 8/1981 | Cox | 114/39.2 |
| 4,322,894 | 4/1982 | Dykes | 36/114 |
| 4,645,466 | 2/1987 | Ellis | 441/74 |

*Primary Examiner*—Joseph F. Peters, Jr.
*Assistant Examiner*—Stephen P. Avila

[57] ABSTRACT

This invention comprises a strap attachable to a surfer, having a foot band, an ankle band and a connecting band therebetween, while a suction cup on an underside of the foot band is attachable upon a surfboard.

1 Claim, 1 Drawing Sheet

FIG. 1
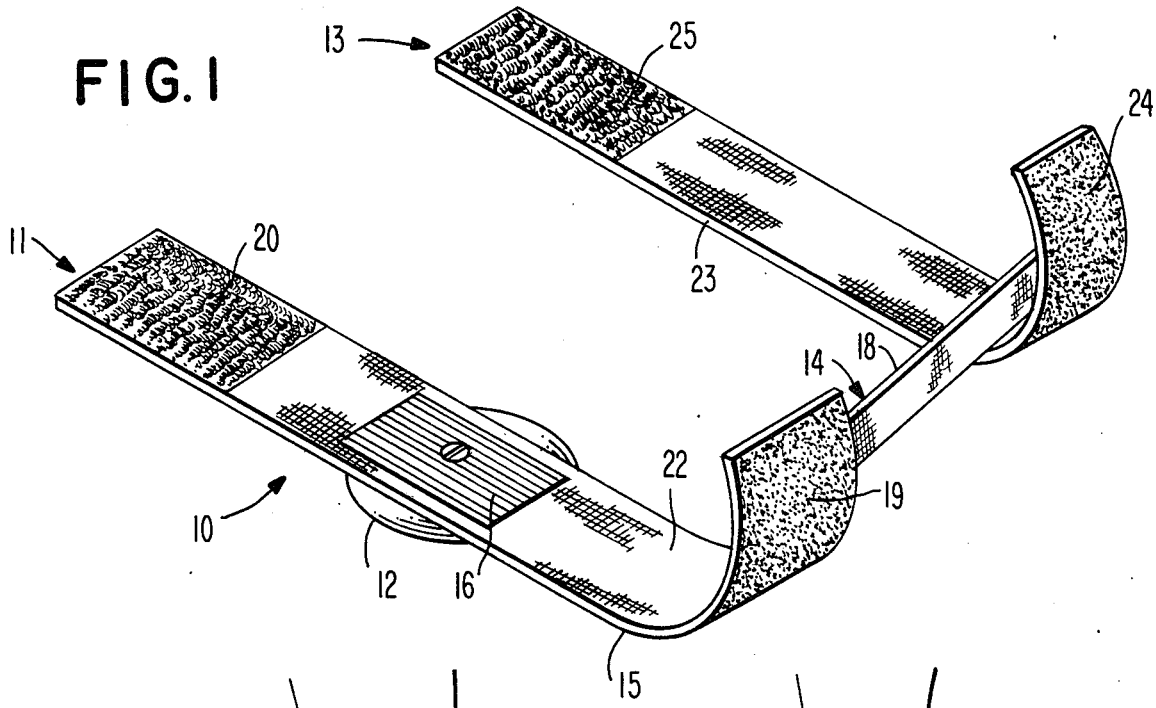
FIG. 2
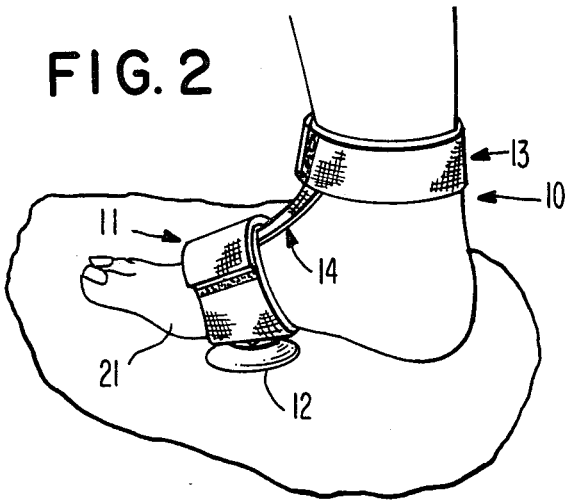
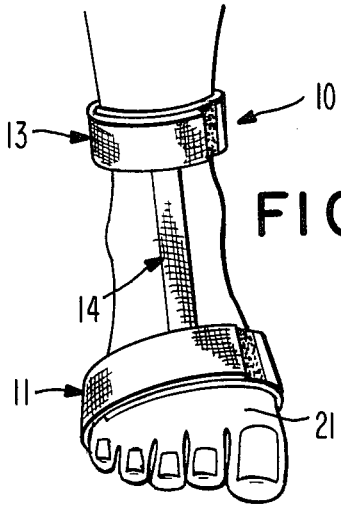
FIG. 3
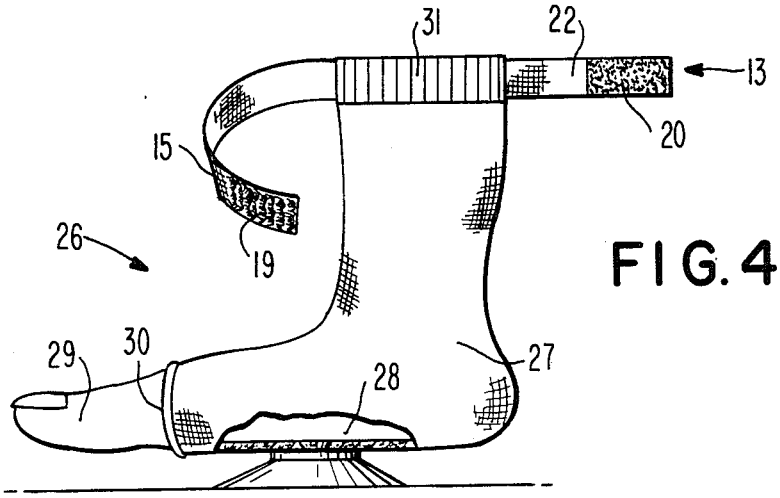
FIG. 4

SURF AIR STRAP

BACKGROUND OF THE INVENTION

Field of the Invention: This invention relates generally to the sport of water surfing, wherein a rider attempts to ride a surfboard on crests of breaking ocean waves. More specifically, it relates to surfboard accessories.

DESCRIPTION OF PRIOR ART

It is well known that surfing has evolved greatly over the past decade or so. The traditional long-board, big wave rider is slowly being replaced by a new generation of surfers, for whom surfing is no longer simply the thrill of riding the largest waves at the greatest speeds, but the challenge of performing fancy and difficult maneuvers on the face of the wave. The modern surfer, while riding an ideal wave, focsses his attention on executing fancy maneuvers such a turns, cutbacks, off the lips, aerials, three hundred sixty degrees, etc. In short, today the worth of a surfer is no longer simply measured by speed and distance, but rather by his ability to perform difficult maneuvers on a given wave.

The possibility of executing maneuvers, however, is limited in surfing as it exists today, because the modern surfer must depend solely on the natural forces of gravity in order to keep in contact with the surfboard. While jumping or turning on a wave, the modern surfer is often seen bending down, and manually holding on to the sides of the board, for fear of losing contact with it while doing aerials.

SUMMARY OF THE INVENTION

Therefore, it is a principal object of the present invention to provide a Surf Air Strap, which, by eliminating this major limitation, allows the modern surfer to perform aerial maneuvers with more stability and control over the board.

More specifically, another object is to provide a Surf Air Strap, whereby a surfer wearing it can now not only get more air while executing aerial maneuvers, but perform such maneuvers more frequently, and most importantly, try new maneuvers such as aerial three hundred sixty degee turns, for example. The Surf Air Strap is a small and simple device, which takes modern surfing one step further, by creating more possibilities for surfers.

In the sport of windsurfing, this same kind of effect is achieved by permanently affixing a strap on to the board, and having the operator slip his foot under it. While the Surf Air Strap basically serves the same purpose, it has many advantages over such a permanently mounted strap.

Unlike the windsurfer, the surfer is in a prone position on the surfboard, more often than he is in a standing one. Paddling, being such a big part of the sport of surfing, makes mounting a permanent strap on to the surface of the surfboard both an unpractical and uncomfortable solution. The Surf Air Strap offers the hold of the permanent strap, without encumbering the surface of the surfboard.

Another advantage that the Surf Air Strap has over the permanently affixed strap is that, while the first can serve its function on any given spot of the surfboard, the second, being permanently mounted, cannot. The suction cup at the bottom of the Surf Air Strap will stick to any part of the surfboard where the surfer chooses to press down his foot, and it has been designed so that even once the suction cup is stuck on to the board, the surfer can slide it around over the surface of the surfboard, without ever having to release its hold.

This flexibility offered by the Surf Air Strap is important for two main reasons; first, because it allows each surfer to find his own comfortable spot on the surfboard: and second, because it allows the surfer to change his position if and when necessary. The freedom and ability to change positions is imperative in a sport such as surfing, in which the "ideal position" depends on many variable factors, such as the size and weight of the surfer, the size and weight of the board, the size and strength of the wave, and, most importantly, on the type of maneuver the surfer is about to perform. For example, a surfer attempting to pick up speed on a particular wave will have to move his feet forward, and balance his weight more towards the front of the surfboard; while a surfer wanting to slow down will have to do the opposite. A permanently affixed strap would limit this freedom of movement, without which surfing would become an awkward sport. The Surf Air Strap offers the hold of a permanent strap, without limiting the surfer's freedom of movement.

It should be noted that, although the Surf Air Strap holds the surfboard securely, its use is not in any way dangerous to the surfer because of its easy release quality. The Surf Air Strap can be released from the board in two easy ways. First, the surfer can just slide his foot off the side of the surfboard, to free himself from the strap's hold. Second, by simply pulling up on the foot wearing the strap, and pressing down with the other foot, the surfer can break the suction cup's air seal, and release its hold. The suction cup's hold over the surfboard can be a very strong and stable one, when the surfer's foot is in a steady position over it: but the suction cup's air seal can also easily be broken, if the surfer moves his foot. This is one of the great qualities of the Surf Air Strap, because it prevents injuries. In elaborate tests performed by the inventor of the Surf Air Strap, the device proved to automatically release its hold from the surfboard, in cases where the surfer suddenly lost his balance, and fell into the water. The inventor also found that the wax traditionally used by surfers on surfboards is also helpful, while using the Surf Air Strap, because it allows the suction cup both to stick, and slide more easily over the surface of the board.

The Surf Air Strap is a device designed to advance the sport of surfing, by allowing the surfer greater control over the surfboard. Simply put, the Surf Air Strap is a foot band with a suction cup at the bottom of it. The surfer wearing the Surf Air Strap, by simply pressing his foot against the surfboard, causes the surfboard to stick to his foot. Establishing a strong and stable hold between the surfer's foot and the surfboard, without restricting freedom of movement, is the principal function of the Surf Air Strap.

Other objects are to provide a Surf Air Strap, which is inexpensive so as to be affordable, is quick and easy to put on or off the surfer's foot, and is efficient in operative use.

These, and other objects, will be readily evident, upon a study of the following Specification and the accompanying Drawing.

BRIEF DESCRIPTION OF THE DRAWINGS

FIG. 1 is a perspective view of a Surf Air Strap shown in accordance with the present invention;

FIG. 2 is a side perspective view of the invention, shown as it would be used;

FIG. 3 is a front perspective view of the invention as it would be worn, and FIG. 4 is a side elevational view of another embodiment of the preferred embodiment of FIGS. 1 to 3, except being in the form of an open toed sock, being made of an ankle and foot support. (This embodiment includes a calf strap for proper fit.)

DETAILED DESCRIPTION

Referring now to the Drawing in greater detail, and more particularly to FIGS. 1 to 3 thereof, at this time, the reference numeral 10 represents a Surf Air Strap, incorporating the invention, wherein it is simply composed of three parts; a foot band 11 with suction cup 12, an ankle band 13, and a connecting band 14.

The foot band is a nine and one-fourth inch by two inch strip of webbing 15 with a circular one-half inch diameter hole and a two inch long cut at the center of it. A specially made suction cup includes a three inch by one and one-half inch rubber pad extension 16, that is slipped through the webbing opening. The line cut across the circular hole is then sewn back together, and the rubber pad is double stitched to the webbing in order to secure it in place.

The rubber pad is necessary to the Surf Air Strap, because it provides stability for the suction cup, and also because it helps keep the suction cup flat against the foot. The post 17 that connects the rubber pad to the suction cup also has an important function; it fills the gap between the arch of the foot and the surfboard. It is important to note, that the suction cup itself will vary in size according to individual weight and preference; the smallest being two and one-half inches in diameter, and the largest four inches.

Next, the connecting band, a strip of six inch by one inch webbing 18, is sewn to the top right end of the foot band and ankle band.

Once the suction cup and the connecting band have been sewn into place, a strip of two inch by three and one-fourth inch male velcro loop pile 19 is placed on the right corner of the foot band and sewn into place. A two inch by five inch strip of female velcro loop pile 20 is then sewn on to the left edge of the foot band. The foot band is fastened around the foot by bringing the male and the female strips of the velcro loop pile together, over the top of the foot, leaving the suction cup in the arch of the foot, and the connecting strap lying over the foot 21.

To complete the foot band, a strip of neoprene 22, with the same dimensions as the original strip of webbing used, is sewn on top of the foot band. The strip of neoprene will provide cushioning and comfort once the foot band is fastened around the foot.

The ankle band, which is the third part of the Surf Air Strap, is a nine and one-fourth inch by one and one-half inch strip of webbing 23. The right end of the ankle band is covered with a three inch by one and one-half inch strip of male velcro loop pile 24. A four inch by one and one-half inch strip of female velcro loop pile 25 is then extended from and sewn on to the left edge of the ankle band.

Next, a nine and one-fourth inch by one and one-half inch strip of neoprene, with the same dimensions as the original strip of webbing used for the ankle band, is sewn on to the ankle band to provide cushioning and comfort. The ankle band is fastened by bringing the male and female velcro loop pile together around the ankle. The completed Surf Air Strap is easy to put on, light in weight, fits both the left and the right foot, and is very comfortable to wear.

The ankle band is an essential part of the Surf Air Strap, for two reasons; first, because it holds the foot band in place, and prevents it from sliding off the front of the foot, and second, because it serves as a leash for the foot band, which is designed for easy removal from both the surfboard and the surfer's foot. The ankle band is also an important part of the Surf Air Strap, because it allows the surfer the convenience of being able to use the device only on selected waves. When paddling out, or any other time out in the water, during which the surfer does not wish to use the strap, he can easily fasten the foot band around the ankle, without being burdened by its presence.

The use of the Surf Air Strap is simple, mainly because it does not complicate or change the basic elements of the sport of surfing. Whether a surfer is wearing the Surf Air Strap or not, he paddles out for a wave lying on his stomach. After picking up enough speed, he balances his weight on his feet, and stands upon the surfboard, while riding the wave. It is only after the wave has been caught, and the surfer has maintained balance on it, that the function of the Surf Air Strap comes into play. The surfer equipped with the Surf Air Strap, by simply pressing down lightly on his foot, causes the suction cup to stick to the surfboard, thus allowing him control otherwise impossible.

Referring now to FIG. 4, a modified design of the Surf Air Strap 26 is shown, that includes an open toe sock 27, for receiving a wearer's foot 28, and having the toes 29 project outward from a front opening 30. The above described foot band 11, in this form of the invention, includes the webbing 15 and neoprene strip 22; however, they are shortened, so as to fit lengthwise in the bottom of the sock, while the above described velcro loop piles 19 and 20 are eliminated. The suction cup 12 extends down underneath the sock. The above described ankle strap 13 is affixed around a top end 31 of the sock. Thus, in this design, the sock replaces the connecting band 14, but functions the same.

While various other changes may be made in the detail construction, it is understood that such changes will be within the spirit and scope of the present invention, as is defined by the appended claims.

What I now claim is:

1. A surfing footstrap comprising, in combination, a band assembly for rigid securement around a surfer's foot, the band assembly including a foot band, an ankle band, and a connecting band extending along the top of the foot and joining the foot band and the ankle band; the ankle band and foot band having hook and loop adjusting means, a single large suction cup attached directly to the foot band which provides a gripping force on a surfboard, the suction cup allowing the foot to pivot and slide on waxes surfaces, and the footstrap permitting the toes and heel of the foot to directly contact the surfboard.

* * * * *